US005499816A

United States Patent [19]

Levy

[11] Patent Number: 5,499,816

[45] Date of Patent: Mar. 19, 1996

[54] DYNAMIC LOTTERY TICKET VALIDATION SYSTEM

[75] Inventor: Bret Levy, Atlanta, Ga.

[73] Assignee: Scientific Games Inc., Alpharetta, Ga.

[21] Appl. No.: 128,926

[22] Filed: Sep. 29, 1993

[51] Int. Cl.[6] ..... A63F 9/00

[52] U.S. Cl. ..... 273/139

[58] Field of Search ..... 273/138 A, 139, 273/269; 283/49, 72, 901, 903; 341/106

[56] References Cited

U.S. PATENT DOCUMENTS

| | | | |
|---|---|---|---|
| 4,191,376 | 3/1980 | Goldman et al. | 273/139 |
| 4,677,553 | 6/1987 | Roberts et al. | 283/903 |
| 4,725,079 | 2/1988 | Koza et al. | 283/903 |
| 4,832,341 | 5/1989 | Muller et al. | 273/139 |
| 4,993,714 | 2/1991 | Golightly | 273/138 A |
| 5,317,135 | 5/1994 | Finocchio | 235/375 |

*Primary Examiner*—Angela D. Sykes
*Assistant Examiner*—Eric F. Winakur
*Attorney, Agent, or Firm*—Michael B. McMurry; Patrick L. Patras

[57] ABSTRACT

A lottery ticket validation system reduces or eliminates spying on the status of tickets. The system uses a compression and encryption process to store its data compactly. The system is not a flag system. No particular bit in the memory corresponds to any given ticket. Thus, spying on a ticket's status by accessing the data base is extremely difficult. The amount of memory allocated to the system is altered dynamically during the lifetime of a game depending on how many tickets have been validated. In this way, memory requirements are kept-low.

35 Claims, 6 Drawing Sheets

*Fig. 4*

| | ,0 | ,1 | ,2 | ,3 | ,4 | ,5 | ,6 | ,7 | ,8 | ,9 | ,10 | ,11 | ,12 | ,13 | ,27 | ,28 | ,29 |
|---|---|---|---|---|---|---|---|---|---|---|---|---|---|---|---|---|---|
| 0, | 0 | 1 | 1 | 1 | 1 | 1 | 1 | 1 | 1 | 1 | 1 | 1 | 1 | 1 | 1 | 1 | 1 |
| 1, | 0 | 1 | 2 | 3 | 4 | 5 | 6 | 7 | 8 | 9 | 10 | 11 | 12 | 13 | 27 | 28 | 29 |
| 2, | 0 | 1 | 1 | 3 | 6 | 10 | 15 | 21 | 28 | 36 | 45 | 55 | 66 | 78 | 351 | 378 | 406 |
| 3, | 0 | 0 | 0 | 1 | 4 | 10 | 20 | 35 | 56 | 84 | 120 | 165 | 220 | 286 | | | |
| 4, | 0 | 0 | 0 | 0 | 1 | 5 | 15 | 35 | 70 | 126 | 210 | 330 | 495 | 715 | | | |
| 5, | 0 | 0 | 0 | 0 | 0 | 1 | 6 | 21 | 56 | 126 | 252 | 462 | 792 | 1287 | | | |
| 6, | 0 | 0 | 0 | 0 | 0 | 0 | 1 | 7 | 28 | 84 | 210 | 462 | 924 | 1716 | | | |
| 7, | 0 | 0 | 0 | 0 | 0 | 0 | 0 | 1 | 8 | 36 | 120 | 330 | 792 | 1716 | | | |
| 8, | 0 | 0 | 0 | 0 | 0 | 0 | 0 | 0 | 1 | 9 | 45 | 165 | 495 | 1287 | | | |
| 9, | 0 | 0 | 0 | 0 | 0 | 0 | 0 | 0 | 0 | 1 | 10 | 55 | 220 | 715 | | | |
| 10, | 0 | 0 | 0 | 0 | 0 | 0 | 0 | 0 | 0 | 0 | 1 | 11 | 66 | 286 | | | |
| 11, | 0 | 0 | 0 | 0 | 0 | 0 | 0 | 0 | 0 | 0 | 0 | 1 | 12 | 78 | | | |
| 12, | 0 | 0 | 0 | 0 | 0 | 0 | 0 | 0 | 0 | 0 | 0 | 0 | 1 | 13 | | | |
| 13, | 0 | 0 | 0 | 0 | 0 | 0 | 0 | 0 | 0 | 0 | 0 | 0 | 0 | 1 | | | |
| 14, | 0 | 0 | 0 | 0 | 0 | 0 | 0 | 0 | 0 | 0 | 0 | 0 | 0 | 0 | | | 77,558 760 |

40 42 44 46 48 50 52

DYNAMIC LOTTERY TICKET VALIDATION SYSTEM

BACKGROUND OF THE INVENTION

1. Field of the Invention

The invention relates to lottery ticket validation systems, and more particularly, to validation systems that maintain data bases of validated tickets.

2. Description of Related Art

The invention relates to a dynamic lottery ticket validation system, and more particularly, to a process of validating instant lottery tickets on-line or through a dial-up network while keeping storage requirements low and validation speed high. To achieve these goals, the present invention utilizes a compression process to store the data compactly. This process also increases security with respect to the data. Memory is allocated dynamically to ensure efficient use of memory.

Instant lottery ticket games typically are conducted over a large geographic area—e.g., state-wide, and use a series of lottery terminals that are connected to a central computer to validate winning tickets that are being redeemed. It is considered desirable that the terminals be capable of determining whether any given ticket presented to be paid already has been paid. In addition, a system must be able to communicate the fact that a ticket has been paid so that if the ticket is later stolen or fraudulently presented for payment, it is not paid again.

Hence, all of the lottery terminals must have access to a data base that contains information as to which tickets already have been paid. The data base must be able to convey information at high speed so that the validation process takes only a few seconds. Moreover, the data base must be able to update the list of validated tickets quickly.

One approach to validation methodology for instant lottery tickets is to maintain a "flag" in a data base for each ticket that identifies the ticket as paid or unpaid. This approach requires a unique flag for every ticket in a game.

The next logical step is to maintain flags only for the potential winning tickets. Thus, if only one fourth of the tickets in a given pack are winning tickets, the system can reduce the number of flags required by three quarters because losing tickets are ignored. Assuming each flag is one bit (e.g., 0=unpaid, 1=paid), the status of the potential winning tickets can be stored as a string of successive bits. Typically, the information for each pack of lottery tickets is stored as a pack record.

This methodology currently is utilized in several lotteries. It does, however, have at least three drawbacks. First, the "paid" bits are clearly identifiable within the pack record, and are therefore reasonably ascertainable. As a result, a person who steals tickets and manages to gain access to the data base may be able to determine which tickets already have been paid. By only presenting the unpaid winning tickets in a pack, this person may be able to escape detection. Second, the number of tickets remaining to be paid in a pack is also "visible" which would provide whomever is in possession of the pack with information as to the value of the pack. Finally, each of the existing systems mentioned requires storing a data field of a fixed length no matter how many tickets have been validated.

Hence, a system providing for added security while maintaining compact storage requirements is desirable.

SUMMARY OF THE INVENTION

It is therefore a general object of the present invention to provide a system to solve the aforementioned problems.

More particularly, it is an object of the present invention to provide security in the lists of validated instant lottery tickets. It is a related object to maintain these lists compactly. Additionally, it is an object to provide for dynamic adjustment of the size of the memory allocated for storing the validation data.

These objects are accomplished by storing a list of validated ticket numbers in a single compressed number. Each single compressed number holds the data representing the list of up to a set quantity of winning ticket numbers. The single compressed numbers are manipulated to extract the list of already validated ticket numbers. Similarly, when a new ticket number is added to the list, the new list is compressed into a new single compressed number which replaces the old one. In this way, storage requirements are kept low while the system is able to maintain a high level of security.

Because the single compressed numbers of the present invention vary in size throughout the lifetime of a game, first increasing and later decreasing, the number of bits required to represent the single compressed numbers varies as well. By only allocating the amount of memory currently required to store a given single compressed number, the present invention stores validation data more compactly than is possible in a bit mapping system. Alternatively, the dynamic allocation of memory can be achieved by allocating a segment of memory for a single compressed number only after one of the ticket numbers to be represented by the single compressed number is presented for validation.

BRIEF DESCRIPTION OF THE DRAWINGS

FIG. 4 is a schematic view of part of a two-dimensional table used in a compression process used in the system of FIG. 1;

DETAILED DESCRIPTION OF THE INVENTION

Figure 1:
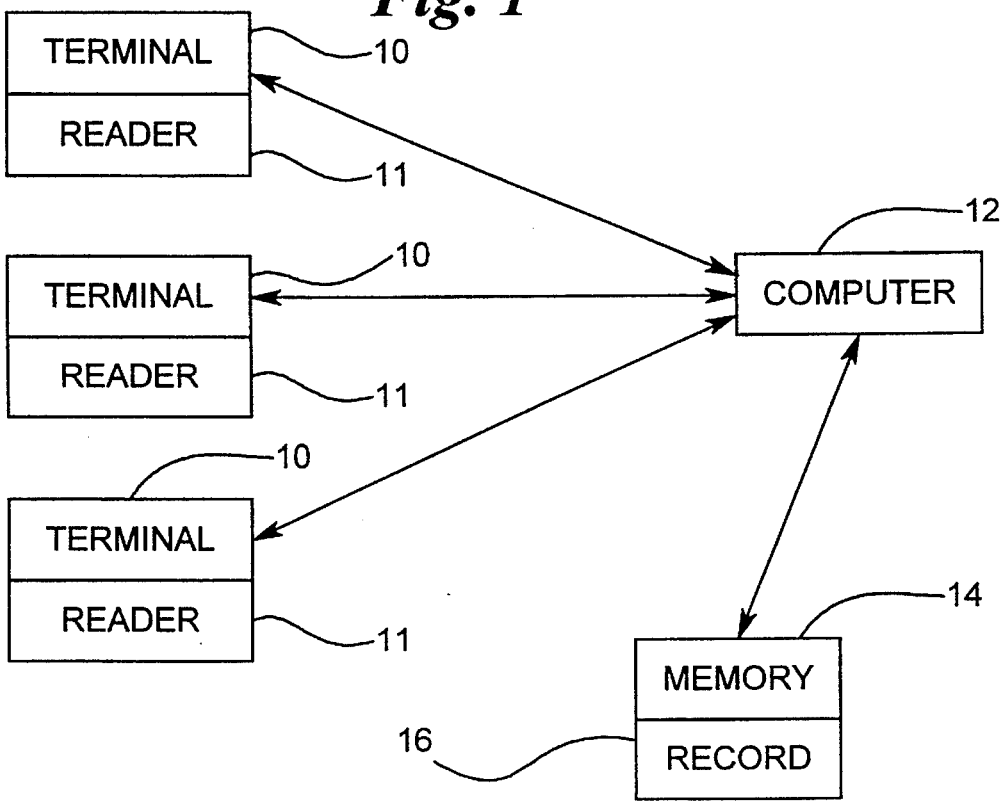
FIG. 1 is a block diagram of an on-line lottery validation system.

Shown in FIG. 1 is an on-line lottery validation system having three major components: a group of lottery terminals 10; a main computer 12; and a memory 14.

Figure 3:
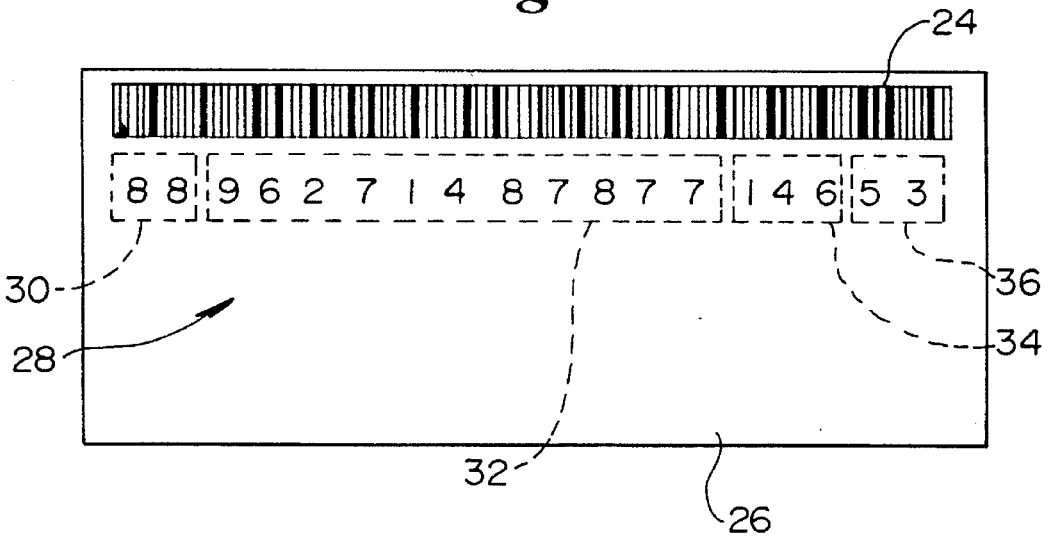
FIG. 3 is a schematic view of an instant lottery ticket of the type used with the system of FIG. 1.

The lottery terminals 10 are used to read ticket information from a lottery ticket 26. In the preferred embodiment, this ticket information is represented as a bar code 24 on the ticket 26 as illustrated in FIG. 3 and is read by a bar code reader 11.

A main computer 12 is used to perform the necessary computations on the data so as to determine the status of a given lottery ticket number.

Figure 2:
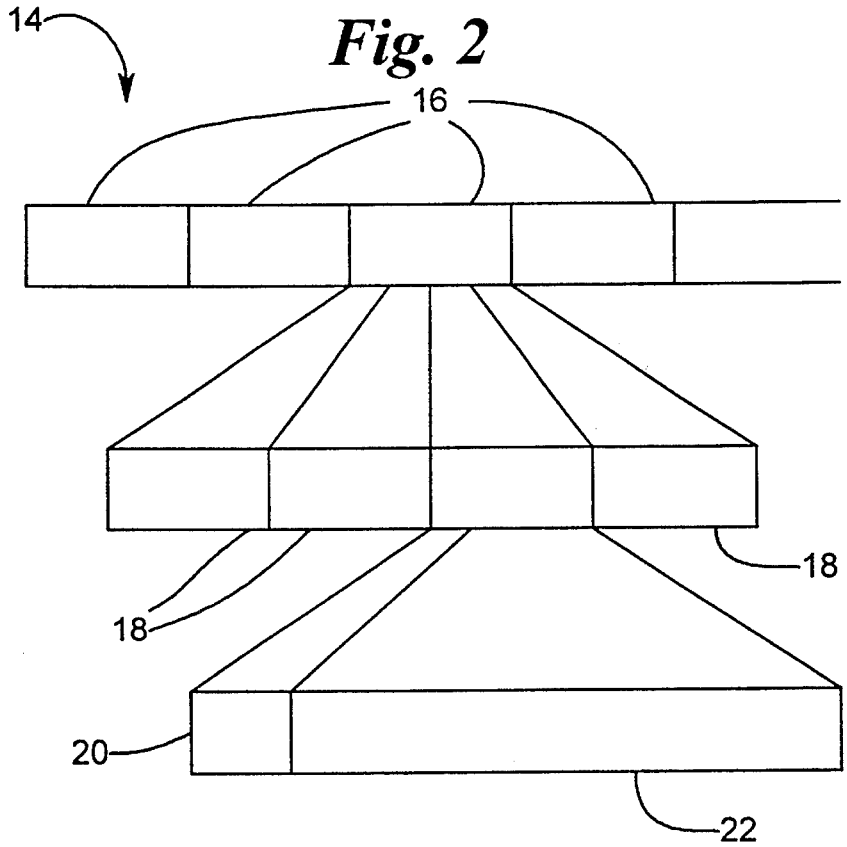
FIG. 2 is a schematic view of a record in the memory used in the system of FIG. 1.

Finally, the invention provides for a digital memory 14 to store data corresponding to a list of ticket numbers as well as their status. In the preferred embodiment, as shown in FIG. 2, the digital memory 14 is allocated to provide a memory area known as a pack record 16 for each pack of tickets involved in the game. Each pack record 16 is subdivided into segments be. For example, in FIG. 2, pack record 16 is subdivided into four segments be. Each segment be is capable of storing the validation status of the same quantity of tickets. Because the quantity of tickets per pack in some cases may not be exactly divisible by the quantity of tickets per segment be, "extra" storage may exist.

For example, the preferred embodiment of the invention stores data representing 29 ticket numbers in each segment 18. If each pack of tickets in a game contains 50 potential winning tickets, two segments 18 of memory 14 will be used per pack. Because two segments be can store data representing 58 potential winning tickets, the extra segment space can be used to store other data about the pack. For example, if a pack of tickets is stolen, ticket number 54 could be set as "paid." To check whether a pack has been stolen, the system simply needs to check whether ticket number 54 has been "paid." Other status information can be maintained the same way on a per pack basis—e.g., packs can be marked as lost, returned, activated or settled (i.e., all winning ticket numbers in the pack have been paid.)

FIG. 3 shows an example of one type of ticket 26 that is used with the present invention. In the preferred embodiment, a bar code 24 is printed on each ticket 26. This bar code includes a game number, a pack number, a compressed validation number, a ticket inventory number and one or more check digits. The information stored in the bar code can be present in human-readable form 28 on ticket 26 as well. Here, a game number 30 is represented by the first two digits. The next eleven digits 32 can comprise five digits representing a pack number and six digits representing a validation number. These eleven digits typically are in an encrypted form such that only computer 12 can compute the pack number and the validation number from these eleven digits.. The validation number includes a prize level, a winner in pack identification number and a data field indicating the number of winning tickets in the pack (the GLEPS type).

A ticket inventory number 34 can be represented by the next three digits. Ticket inventory number 34 is used solely for inventory purposes and is not necessary to the present invention. Finally, a pair of check digits 36 are the last two digits in the human-readable form 28 of the information represented by bar code 24 in FIG. 3.

The game number 30 indicates the lottery game to which ticket 26 pertains. The pack number indicates the pack of tickets within that game from which ticket 26 comes. The prize level is the value of the prize won for a particular ticket 26—e.g., $ 5. The winner in pack identification number is a number that reflects which winning ticket this is within a given pack, with the first winning ticket being numbered zero, the second winning ticket being numbered one, etc. The GLEPS type describes an aspect of the game that guarantees that each pack of tickets will have a guaranteed, predetermined number of low-end winning tickets.

When an individual presents an instant lottery ticket 26 for payment, the lottery agent must determine whether ticket 26 already has been paid. As noted above, in the preferred embodiment, the ticket's information is inputted by the reading of a bar code printed on ticket 26 by bar code reader 11. The pack number guides the system to the correct pack record 16. The winner in pack identification number dictates which of the segments 18 within pack record 16 is to be used. In other words, in the preferred embodiment, the system knows that a winner in pack identification number between 0 and 28 corresponds to the first segment 29–57 to the second segment 18, etc.

If the winner in pack identification number leads to any segment 18 beyond the first one, a simple subtraction of the first ticket number in that segment 18 is performed to determine the place of the winner in pack identification number within this segment 18. Thus, in the preferred embodiment, winner in pack identification number 32 corresponds to ticket number 3 in the second segment 18. This computed ticket number, i.e., the number of the ticket based upon its position within its segment 18, will be referred to as the "ticket number." In the preferred embodiment, the ticket number always will be between 0 and 28 inclusive. It is this ticket number that computer 12 stores and manipulates within segment 18.

Computer 12 then checks whether this ticket number is contained in the list of already validated (i.e., paid) ticket numbers for this segment 18. If the ticket number is found in this list, the agent is notified via terminal 10 to refuse payment on the ticket. Assuming, however, that the ticket number is not in the list, the agent pays the ticket and, via terminal 10, causes computer 12 to add this ticket number to the list of validated ticket numbers.

The system stores the list of validated ticket numbers in a segment 18 of memory 14. The number of bits required to store this list is only slightly larger than the quantity of ticket numbers it is responsible for monitoring.

In the preferred embodiment, the segment 18 is 32 bits long. This size is convenient for a computer to manipulate. In this embodiment, segment 18 stores the status of 29 ticket numbers. Thus, in 32 bits of memory 14, segment 18 holds data yielding the quantity of tickets already validated (a number from 0–29) as well as a list of which of the 29 ticket numbers already have been validated. The system does not accomplish this using a single bit corresponding to each of the 29 ticket numbers—i.e., this is not a flag system. As a result, segment 18 of the system makes obtaining unauthorized information on the status of the tickets more difficult.

Segment be has two portions. A count portion 20 represents the quantity of ticket numbers already validated. A single compressed number portion 22 represents a list of the validated ticket numbers. In the preferred embodiment, the first five bits of segment be store count 20 of the quantity of ticket numbers already validated, and the last 27 bits of segment be store single compressed number 22.

Here, choice of storing the status of 29 ticket numbers per segment 18 is not made arbitrarily. Using five bits for count 20 allows it to reach as high as 31. The reason that 30 or 31 ticket numbers per segment be cannot be used in the preferred embodiment is because of the limitation on the size of single compressed number 22. Single compressed number 22 is 27 bits. As described below, the largest entry 52 in a two-dimensional table 40 of FIG. 4 is 77,558,760. Thus, the largest possible single compressed number 22 that would have to be stored is 77,558,759 because initializing a seed requires subtracting one from the table entry. (This process is more fully described below.) This number requires 27 bits to represent it. If 30 or 31 ticket numbers per segment 18 were used, the largest potential single compressed number 22 would be correspondingly larger. This larger single compressed number would require more than 27 bits to represent it, and would therefore increase the size of segment 18 beyond the computer convenient 32 bits.

Thus, in the preferred embodiment, count 20 will be a number ranging from 0–29. In order to fit into 27 bits, however, single compressed number 22 will not always list the already validated ticket numbers. If it requires maintaining a list of less numbers, the system instead will store the list of not yet validated ticket numbers in single compressed number 22. This alternative will be used when more than one half of the ticket numbers represented by segment 18 already have been validated. In other words, the system takes advantage of the fact that if, e.g., 25 of the 29 ticket numbers have been validated, then four of the 29 ticket numbers have not been validated. Moreover, less memory is required to store an encrypted list of those four numbers than to store a corresponding list for 25 numbers.

The system is able to discern whether the list comprises validated or not yet validated ticket numbers based upon count 20. If count 20 is greater than the integer result of dividing the total quantity of ticket numbers per segment 18 by two, then the system knows that what is stored is actually a list of not yet validated ticket numbers. Thus, after extracting this list from the segment 18, if the list actually contains the not yet validated ticket numbers, the system will complement the list so as to obtain the list of validated ticket numbers.

Segment 18 stores a unique number that corresponds to only one of the possible combinations of validated ticket numbers within the segment 18. Thus, the system assigns an integer to each of the possible combinations. One of the many ways to do this is to list all the possible combinations of ticket numbers and sequentially number them in a table. If unique numbers are assigned in that manner, there is no need for count 20. A single compressed number 22 is all that is used. In the preferred embodiment, the system uses a more complicated process in order to provide added security and a minimization of memory required.

Computing the proper value to store a list of validated ticket numbers in segment 18 is achieved as follows. Reference will be made to the preferred embodiment by way of example. The first five bit portion is simply the count 20 of validated ticket numbers. Thus, if 27 of the 29 ticket numbers were validated, the first five bit portion of segment 18 would be: 11011.

The second portion of segment 18, single compressed number 22, is much more difficult to compute and is based on the values stored in a two-dimensional table 40 that is shown partially in FIG. 4. This two-dimensional table 40 is created at the initiation of the game.

Table 40 contains a set of columns 42 numbered from zero to the total quantity of ticket numbers per segment 18 (in the preferred embodiment, 29). Table 40 also contains a set of rows 44 that are numbered from zero to the largest quantity of ticket numbers that will actually be stored in the segment for the complementing list method described above. In the preferred embodiment, this is the integer result of 29/2, or 14.

Each one of an entry 46 (row, column) in the table 40 has a value corresponding to $$\binom{\text{column}}{\text{row}}.$$

These entries 46 are the values of the well-known mathematical choose function $$\binom{x}{y},$$

which gives the value of the number of combinations of y elements that can be chosen from a set of x elements and can be computed by the formula $$\binom{x}{y} = \frac{x!}{y!(x-y)!}.$$

Thus, for example, the (1,7) entry 48 corresponds to the value of $$\binom{7}{1} = 7,$$

and the (2,11) entry 50 corresponds to the value of $$\binom{11}{2} = 55.$$

The values in table 40 increase going left to right along a given row 44. Whenever the row number exceeds the column number the corresponding table entry 46 will be zero. This is because there are zero ways to choose, e.g., five elements out of a set of three elements. The largest value 52 in table 40 used in the preferred embodiment is $$\binom{29}{14} = 77{,}558{,}760.$$

Table 40 is used as the starting point for computing single compressed number 22. When computer 12 is ready to compute a new single compressed number 22, it already knows count 20 (0 through 29) as well as a list of ticket numbers that computer 12 has placed in ascending order.

Figure 5:
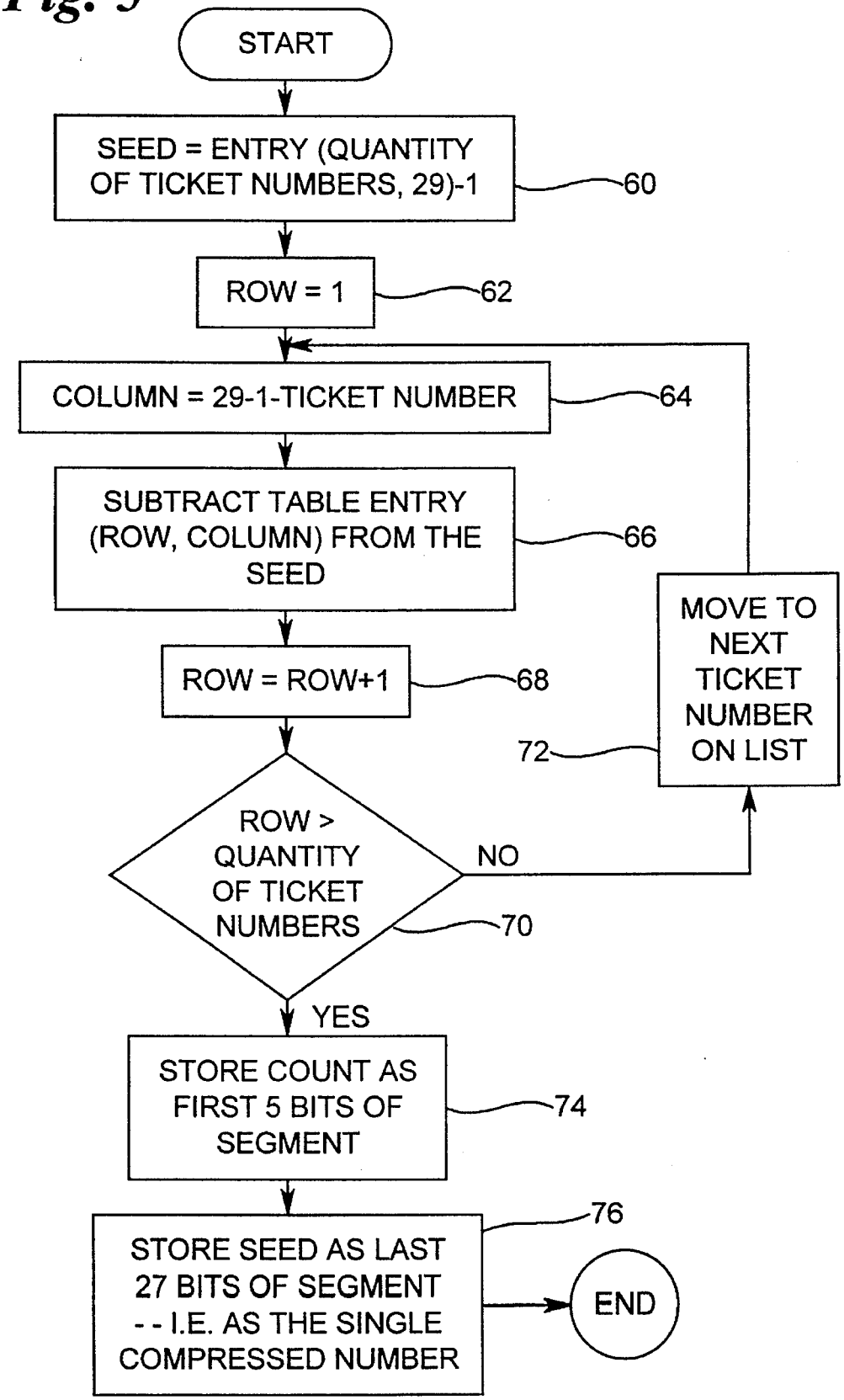
FIG. 5 is a flowchart illustrating the compression operation of the system of FIG. 1.

As shown in FIG. 5, computer 12 begins at block 60 by computing a seed. The seed corresponds to the table entry 46 (quantity of ticket numbers, highest numbered column) −1. Thus, in the preferred embodiment the initial seed would be (quantity of ticket numbers, 29) −1. By way of example if the list contained two ticket numbers: list [0]=17 and list [1]=21, the seed would be $$\binom{29}{2} - 1 = 406 - 1 = 405.$$

After obtaining the seed, computer 12 subtracts from the seed a series of values each of which uniquely identifies a number on the present list. Computer 12 traverses the list from highest ticket number to lowest ticket number to accomplish this task. Thus, in the foregoing example, computer 12 would first subtract from the seed a value which will serve to uniquely identify that 21 is the corresponding ticket number.

This is accomplished by subtracting from the present seed the entry 46 (row, column). Row is the rank order of the ticket number within the list, with the highest being equal to one, the second highest equal to two, etc. At block 62, computer 12 initializes row to one because computer 12 starts with the highest ticket number. Column is computed at block 64 as being the quantity of ticket numbers per segment 18 minus one and then minus the ticket number. Thus, beginning with the highest value in the list, 21, row=1. As 29−1−21=7, column=7. Therefore, at block 66, the (1,7) entry 48, $$\binom{7}{1} = 7,$$

should be subtracted from the seed—i.e., 405−7=398.

Computer 12 then continues by incrementing the row by one at block 68. At block 70, computer 12 determines whether the list is complete. If the list is not yet complete, at block 72, computer 12 moves to the next ticket number on the list. In the example, the next ticket number is 17. The (2,11) entry 50 corresponds to the value of $$\binom{11}{2}=55.$$

Thus, the new seed value=398−55=343. This time, at block 70, the list is complete, and the seed value will not be modified further. This final value is the single compressed number 22 to be stored as the single compressed number portion of segment 18 with count 20 being the other portion.

In the foregoing example, count 20 would be two. Thus, in the preferred embodiment, at block 74, the first five bit portion stored is: 00010. Single compressed number 22 is 343. Therefore, in the preferred embodiment, at block 76, the last 27 bit portion stored is:

000000000000000000101010111.

Segment 18 stored in memory would be:

000100000000000000000000101010111.

Note that single compressed number 22 of segment 18 would have been the same if, rather than the list being [17,21], the list had been [0,1,2,3,4,5,6,7,8,9,10,11, 12,13, 14,15,16,18,19,20,22,23,24,25,26,27,28]. If the list had been the lengthier latter list, computer 12 would have instead stored the list's complement—i.e., [17,21]. Computer 12 discerns the difference between these two situations which both yield an identical single compressed number 22 because of the difference in count 20—i.e., the first five bits are different. Thus, the lengthier list would have a count 20 of 27 and a corresponding segment 18 stored in memory of:

110110000000000000000000101010111.

Figure 6:
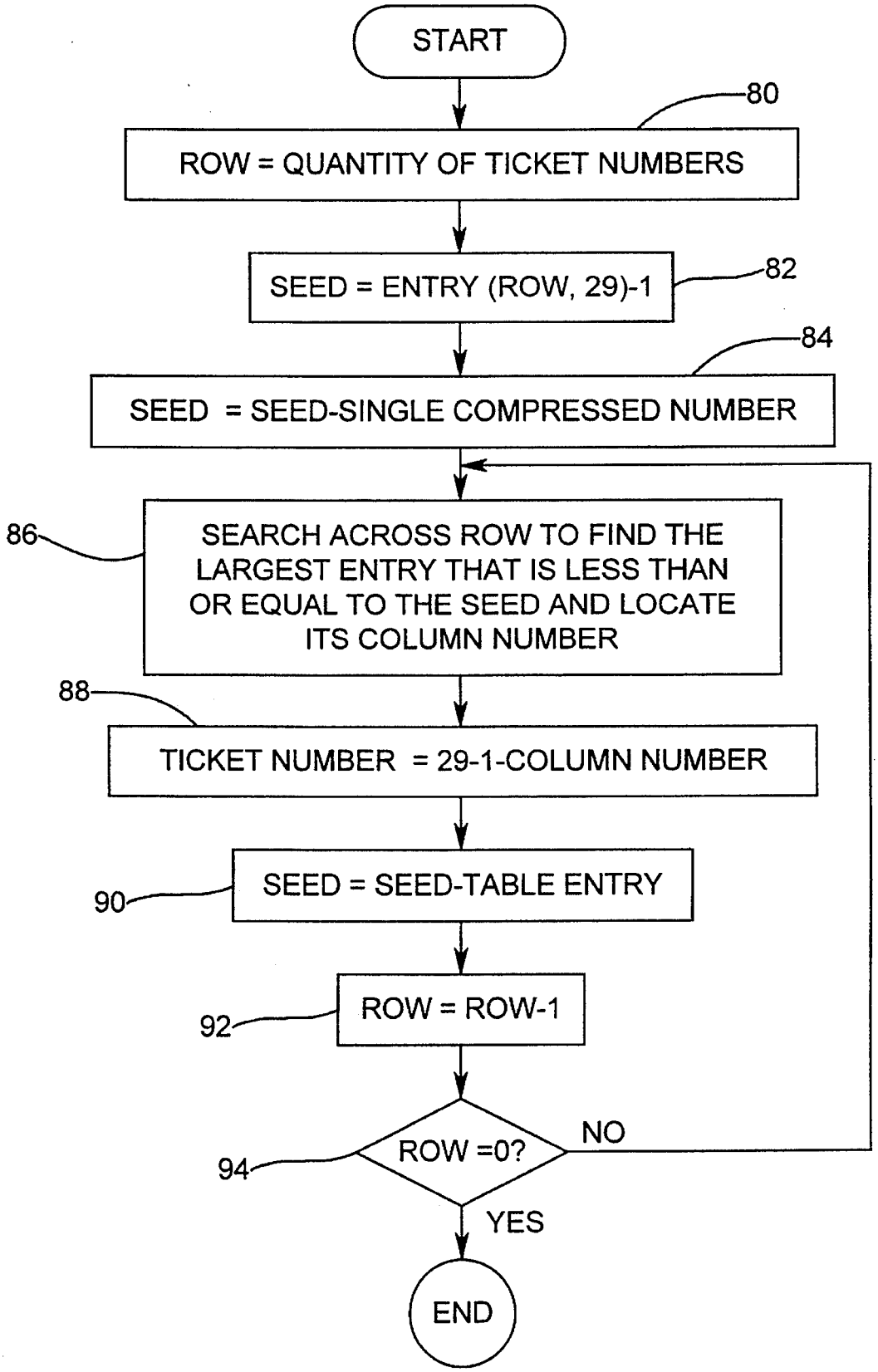
FIG. 6 is a flowchart illustrating an expansion operation of the system of FIG. 1.

When a new ticket number is entered computer 12 must expand the data stored in segment 18 to obtain a list of previously validated ticket numbers. This process is illustrated in the flowchart of FIG. 6. Computer 12 first obtains count 21 from segment 18—i.e., the first five bits in the preferred embodiment. From count 20, computer 12 determines whether single compressed number 22 represents: (1) the list of already validated ticket numbers; or (2) the list of not yet validated ticket numbers. The quantity of ticket numbers actually stored equals count 20 in the former case. In the latter case, the quantity of ticket numbers equals the total quantity of ticket numbers per segment 18 minus count 20. Thus, in the preferred embodiment if count 20 were 25, the quantity of ticket numbers would be 29—25=4.

Computer 12 then uses this quantity of ticket numbers, single compressed number 22 and table 40 to create the list. This creation begins by selecting an initial seed value. At block 80, computer 12 looks to the row number corresponding to the quantity of ticket numbers. Computer 12 then retrieves the entry 46 stored in the highest numbered column 42. Thus, in the example above, the computer 12 would retrieve the entry 46

$$(2, 29)=\binom{29}{2}=406.$$

Computer 12, at block 82, subtracts one to correspond to the subtraction of one performed in creating the list. This leaves the seed at 405. Single compressed number 22 (343 in the example) is subtracted from the seed at block 84, leaving a new seed value of 62.

Computer 12 now creates the list from lowest ticket number to highest. It starts in the row 44 corresponding to the quantity of ticket numbers in order to retrieve the lowest ticket number. The computer 12 searches, at block 86, for the largest entry in that row 44 that is less than or equal to the present seed. In the example, the largest entry 46 in row 2 of table 40 that is less than or equal to 62 is 55. This value is the (2,11) entry 50. At block 88, this column number is subtracted from one less than the highest numbered column to finally obtain the ticket number—i.e., 29—1—11=17. Thus the first ticket number in the list is 17. At block 90, the 55 that was stored in the corresponding table entry 50, is subtracted from the present seed to compute the new seed—i.e., 62−55=7.

The computer 12 then decreases the row number by one at block 92. If the row has not been decreased to zero, then at block 94 the computer 12 then repeats the process using the new seed. Thus, the largest entry in row one that is less than or equal to 7 is the (1,7) entry 48. Therefore, the next ticket number is 29−1−7=21. Because decreasing the row number by one makes it equal to zero, at block 94, computer 12 recognizes that the list is complete. Because the count is 2, and not 27, the list does not need to be complemented.

Computer 12 now checks whether the inputted ticket number is in the list of previously validated ticket numbers. If it is, computer 12 sends an appropriate signal to lottery terminal 10 so that the lottery agent knows not to pay the ticket again.

If this ticket number is not on the list, computer 12 notifies lottery terminal 10 that the agent can pay the ticket. Computer 12 also adds this ticket number to the list, sorts the list in ascending order, increments count 20 and computes a new single compressed number 22 to store with the new count 20 in a segment 18 of memory 14.

As can be appreciated by the foregoing description, the value of single compressed number 22 varies substantially depending on the number of tickets validated within a segment 18. When a relatively small number of tickets have been validated within a segment 18, single compressed number 22 is correspondingly small. Near the midpoint of the validation of the tickets in a segment 18, single compressed number 22 reaches a substantially larger value. Beyond that point, single compressed number 22 begins to decrease, because it represents only the not yet validated tickets.

It can be seen that variations in the size of single compressed number 22 cause similar variations in the number of bits required to store single compressed number 22. Specifically, fewer bits are required both at the beginning and at the end of the validation of the tickets within a segment 18. The present invention takes advantage of this fact to minimize storage requirements dynamically throughout the lifetime of a game, i.e., the time during which tickets may be validated.

Figure 7:
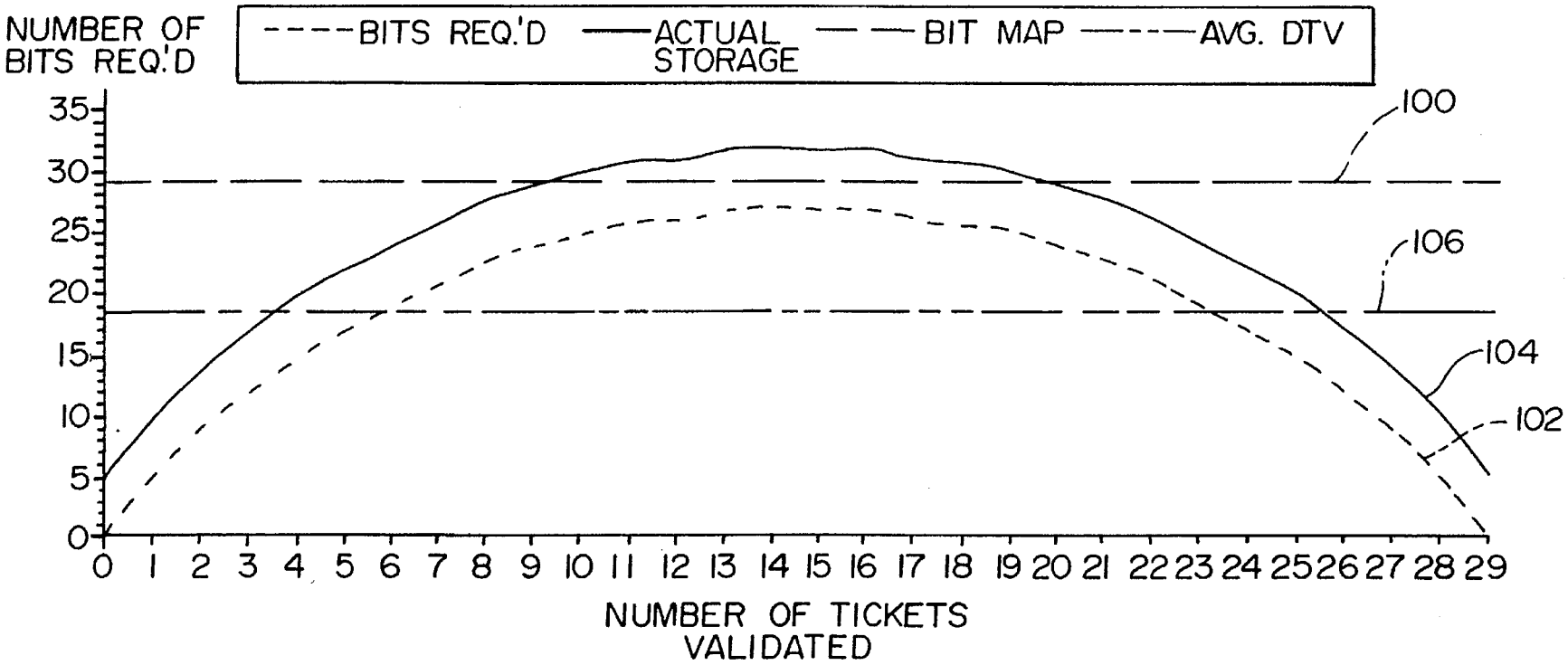
FIG. 7 is a graph comparing the storage requirements of the system of the present invention with the storage requirements of a conventional bit mapping system.

FIG. 7 illustrates the benefit of this feature of the present invention as compared to conventional bit mapping technology. In conventional bit mapping, a single flag is used to represent each potential winning ticket. Hence, line 100 has a constant value of 29 to represent the number of bits required to store the validation status of 29 ticket numbers (the number stored in each segment 18 in the preferred embodiment of the present invention) throughout the lifetime of a game.

To be contrasted with line 100 is curve 102 which represents the number of bits required to store single compressed number 22 of the present invention. Before any tickets have been validated, there is no single compressed number 22 to store and the number of required bits is zero. Similarly, when all 29 of the tickets have been validated, the number of bits required is zero. The remainder of curve 102 illustrates the average number of bits required to store single compressed number 22 at each step of the validation of the tickets within segment 18.

Curve 104 represents the total number of bits required to maintain the status of the tickets within a given segment 18. Curve 104 is five bits higher than curve 102 at each point because curve 104 includes the five bit count 20 as well as the single compressed number 22. As shown by line 16, the average number of bits required by the present invention is substantially lower than the bit map average of 29. Thus, by dynamically allocating only the amount of memory 14 needed to store the validation data, a substantial savings in memory requirements is achieved. Because the amount of memory 14 required when all the tickets in a segment 18 have been validated is minimal, a game essentially clears itself out of memory after a period of time, maintaining only a small amount of memory 14 for itself and releasing most of memory 14 for other applications. This type of allocation requires a reallocation of memory 14 after each ticket is validated.

An alternative embodiment of the present invention utilizes a simpler system of dynamic memory allocation. In this alternative embodiment, memory allocation is performed at the level of the segment 18 rather than at the bit level. Each pack record 16 is one of several distinct sizes. In a game with 75 winning tickets per pack, three segments 18 of memory are required to store all the ticket validation information. In this embodiment, the system does not allocate memory to store a segment 18 until a ticket from that segment 18 is to be validated.

For example, if the only winning tickets to be validated within pack record 16 are among the first 29 winning ticket numbers, only one segment 18 is allocated to this pack record 16. Only when the first winning ticket within the second segment 18 is validated does the system allocate memory to store the second segment 18. The third segment is allocated similarly. Pack record 16 can contain a header that stores the number of segments 18 allocated for this pack. Additionally, the system optionally can purge from memory those segments 18 in which all 29 of the tickets have been validated.

In this embodiment, a large memory serves as a memory pool. This memory pool can be divided into slots of varying size, each size being an integer number of segments. For example, in a game requiring three segments 18 of memory for each pack record the memory slots would be of three sizes—one segment, two segments and three segments.

When the first ticket in a pack is validated, pack record 16 is placed in a one-segment slot of the memory pool. The pack record header tells the system how many segments currently are allocated to this pack. When a second segment is required, pack record 16 is moved to a two-segment slot of the memory pool and the original one-segment slot is released back into the memory pool. After all the winning tickets in a pack are validated, pack record 16 can be removed from memory and, optionally, recorded on a disk. When pack record 16 is removed from memory, memory is released back into the memory pool.

By utilizing the method outlined above, it is possible to maintain a list of paid lottery tickets with reduced memory requirements and with substantially increased security.

What is claimed is:

1. A system for storing lottery ticket numbers comprising:

reading means for reading a plurality of ticket numbers from a plurality of lottery tickets;

computational means operationally connected to said reading means for computing from said plurality of ticket numbers a single compressed number and for converting said single compressed number into said plurality of ticket numbers; and a memory for storing said single compressed number.

2. The system of claim 1 wherein said computational means includes a table having a unique integer entry for each of the possible combinations of ticket numbers.

3. The system of claim 1 wherein said reading means includes a bar code reader.

4. The system of claim 1 wherein each of said ticket numbers includes:

a number corresponding to a pack; and a winner in said pack identification number.

5. The system of claim 1 wherein at least one of said ticket numbers represents a status of a pack to which said ticket number belongs.

6. The system of claim 5 wherein said status indicates that the pack is lost.

7. The system of claim 5 wherein said status indicates that the pack is returned.

8. The system of claim 5 wherein said status indicates that the pack is activated.

9. The system of claim 5 wherein said status indicates that the pack is settled.

10. The system of claim 1 wherein said computational means includes means for storing in said memory a count of a quantity of said ticket numbers.

11. The system of claim 10 wherein said single compressed number and said count are stored in a segment of said memory.

12. The system of claim 11 wherein said segment of said memory is 32 bits.

13. The system of claim 12 wherein five bits of said segment store said count and 27 bits of said segment store said single compressed number.

14. The system of claim 13 wherein said five bits used for said count are the first five bits of said segment of said memory.

15. The system of claim 12 wherein said single compressed number represents a validation status of a quantity of ticket numbers up to twenty-nine.

16. The system of claim 11 wherein said single compressed number in said memory comprises a quantity of bits, said quantity of bits being less than a quantity of said ticket numbers wherein a validation status is represented by said single compressed number.

17. The system of claim 16 wherein said computational means further includes means for modifying the validation status of one of said ticket numbers represented by said single compressed number.

18. The system of claim 17 wherein said modification means includes:

conversion means for translating said single compressed number and said count into a memory array of ticket numbers;

means for adding a ticket number to said memory array;

sorting means for placing said ticket numbers in numerical order in said memory array; and compression means for compressing said array of ticket numbers into said single compressed number.

19. The system of claim 18 wherein said conversion means includes:

a two-dimensional table stored in said memory;

selection means for computing a seed based upon said count, said single compressed number and said two-dimensional table;

means for extracting an array of ticket numbers based upon said seed, said count and said two dimensional table; and updating means for changing said seed after each of said ticket numbers is extracted.

20. The system of claim 19 wherein said two-dimensional table includes:

a plurality of columns numbered zero through the quantity of said ticket numbers stored in said single compressed number;

a plurality of rows numbered zero through a largest quantity of said ticket numbers that the system will have to maintain in said memory, said quantity being equal to the result of dividing said quantity of ticket numbers by two and truncating any fractional part thereof; and a plurality of table entries corresponding to the value of $$\begin{pmatrix} \text{column} \\ \text{row} \end{pmatrix}.$$

21. The system of claim 18 wherein said compression means includes:

a two-dimensional table stored in said memory;

selection means for computing a seed based upon said count and said two-dimensional table;

means for compressing said array into said single compressed number based upon said seed, said count and said two-dimensional table; and updating means for modifying said seed based upon each said ticket number.

22. The system of claim 21 wherein said two-dimensional table includes:

a plurality of columns numbered zero through the quantity of said ticket numbers stored in said single compressed number;

a plurality of rows numbered zero through a largest quantity of said ticket numbers that the system will have to maintain in said memory, said quantity being equal to the result of dividing said quantity of ticket numbers by two and truncating any fractional part thereof; and a plurality of table entries corresponding to the value of $$\begin{pmatrix} \text{column} \\ \text{row} \end{pmatrix}.$$

23. A system for storing lottery ticket numbers comprising:

reading means for reading a plurality of ticket numbers from a plurality of lottery tickets;

computational means operationally connected to said reading means for computing from said plurality of ticket numbers a single compressed number and for converting said single compressed number into said plurality of ticket numbers;

a memory for storing said single compressed number; and allocation means for altering a size of said memory during a lifetime of a game.

24. The system of claim 23 wherein said memory is divided into a plurality of pack records, each of said pack records representing a validation status of the ticket numbers within a pack of tickets.

25. The system of claim 23 wherein said computational means includes means for storing in said memory a count of a quantity of said ticket numbers.

26. The system of claim 25 wherein said single compressed number and said count are stored in a segment of said memory.

27. The system of claim 26 wherein a plurality of segments store said lottery ticket numbers.

28. The system of claim 27 wherein each said segment represents lottery ticket numbers within a sequential range.

29. The system of claim 28 wherein said allocation means allocates a first segment of memory when a first ticket number within a first range is validated.

30. The system of claim 29 wherein said allocation means allocates a second segment of memory when a first ticket number within a second range is validated.

31. The system of claim 30 wherein said allocation means deallocates said first segment of memory when all ticket numbers within said first range have been validated.

32. The system of claim 31 further including a memory pool, and wherein said memory pool is divided into a plurality of slots, each of said slots being a size of an integer number of said segments.

33. The system of claim 32 wherein each said pack record further includes a pack record header representing the size of the slot currently storing said pack record.

34. The system of claim 23 wherein said allocation means increases the size of said memory during a first portion of said game and decreases the size of said memory during a second portion of said game occurring after said first portion.

35. The system of claim 23 wherein said allocation means varies the size of said memory as a function of said single compressed number.

* * * * *